US008117858B2

(12) United States Patent
Taguchi

(10) Patent No.: US 8,117,858 B2
(45) Date of Patent: Feb. 21, 2012

(54) AIR CONDITIONER

(75) Inventor: Yukihiko Taguchi, Isesaki (JP)

(73) Assignee: Sanden Corporation, Iseaki-shi, Gunma (JP)

( * ) Notice: Subject to any disclaimer, the term of this patent is extended or adjusted under 35 U.S.C. 154(b) by 621 days.

(21) Appl. No.: 12/296,089

(22) PCT Filed: Apr. 2, 2007

(86) PCT No.: PCT/JP2007/057374

§ 371 (c)(1),
(2), (4) Date: Jan. 12, 2009

(87) PCT Pub. No.: WO2007/119641

PCT Pub. Date: Oct. 25, 2007

(65) Prior Publication Data

US 2009/0173094 A1 Jul. 9, 2009

(30) Foreign Application Priority Data

Apr. 6, 2006 (JP) ..... 2006-105754

(51) Int. Cl.
*F25B 49/00* (2006.01)
*F25B 13/00* (2006.01)
*B60H 1/32* (2006.01)

(52) U.S. Cl. ..... 62/228.3; 62/244; 62/160

(58) Field of Classification Search ..... 62/228.3, 62/228.5, 159, 160, 239, 244; 417/222.2, 417/270, 278; 251/129.15
See application file for complete search history.

(56) References Cited

U.S. PATENT DOCUMENTS

2004/0177628 A1 9/2004 Kurata et al.

FOREIGN PATENT DOCUMENTS

| | | | |
|---|---|---|---|
| EP | 1020692 | A2 | 7/2000 |
| JP | H05-223357 | A | 8/1993 |
| JP | 2000-205667 | A | 7/2000 |
| JP | 2004-010023 | A | 1/2004 |
| JP | 2004-255913 | A | 9/2004 |

OTHER PUBLICATIONS

European Patent Office, Supplementary European Search Report for European Patent Application No. EP 07 74 0810 (Counterpart to the above-captioned patent application) mailed Feb. 3, 2009.

Patent Cooperation Treaty, International Search Report for International Application No. PCT/JP2007/057374, filed Apr. 2, 2007, mailed Jul. 17, 2007. (Counterpart to above-captioned U.S. patent application.).

Patent Cooperation Treaty, Written Opinion of The International Searching Authority, for International Application No. PCT/JP2007/057374, filed Apr. 2, 2007, mailed Jul. 17, 2007 (Counterpart to above-captioned U.S. patent application.).

*Primary Examiner* — Chen Wen Jiang
(74) *Attorney, Agent, or Firm* — Baker Botts L.L.P.

(57) ABSTRACT

An air conditioner is switchable between a cooling mode and a heating mode using highly pressurized hot gas in a refrigerant cycle. During the cooling mode, a controller controls an input electric current to a solenoid to operate the control valve based on a lower pressure side pressure of the refrigerant cycle acting on a pressure sensitive mechanism and a quantity of the input electric current to the solenoid. During the heating mode, the controller controls the input electric current to the solenoid to operate the control valve based not on the lower pressure side pressure of the refrigerant cycle acting on the pressure sensitive mechanism, but only on the quantity of the input electric current to the solenoid.

19 Claims, 8 Drawing Sheets

FIG.6

$$F(i) - f + Sv \cdot Pc - (Sv - Sr) \cdot Pd + (Sb - Sr) \cdot Ps - F = 0$$

$$Ps = -\frac{1}{Sb - Sr} \cdot F(i) + \frac{(Sv - Sr)}{Sb - Sr} \cdot Pd - \frac{Sv}{Sb - Sr} \cdot Pc + \frac{F + f}{Sb - Sr} \quad \ldots (1)$$

$$(Sv \geqq Sr)$$

Pd: Discharge pressure

Pc: Crank chamber pressure

Ps: Inlet pressure

Sr: Crcoss sectional area of the pressure sensitive rod

Sv: Discharge pressure receiving area of the valve body

Sb: Effective area of the bellows f: Biasing force of the spring 308

F: Biasing force of the bellows

F(i): Electromagnetic force

AIR CONDITIONER

CROSS-REFERENCE TO RELATED APPLICATIONS

This application is the National Stage of International Patent Application No. PCT/JP2007/057374, filed Apr. 2, 2007, which claims the benefit of Japanese Patent Application No. 2006-105754, filed Apr. 6, 2006, the disclosures of which are incorporated herein by reference in their entirety.

TECHNICAL FIELD

The present invention relates to an air conditioner capable of heating mode operation using high pressure hot gas in a refrigerant cycle.

BACKGROUND ART

Patent document 1 teaches a car air conditioner capable of auxiliary heating mode operation for supporting the heating capability of a water heater, wherein high pressure hot gas in a refrigerant cycle is led to an evaporator to heat air flowing through an air duct. ON/OFF operation of a compressor of the aforementioned air conditioner is controlled based on the detection signal of a pressure sensor for detecting pressure of the high pressure refrigerant in the refrigerant cycle.

Patent document 1: Japanese Patent Laid-Open Publication No. 5-223357

DISCLOSURE OF INVENTION

Problem to be Solved

[Object of the Invention] An object of the present invention is to provide an air conditioner whose operation mode is switchable between cooling mode and heating mode using highly pressurized hot gas in refrigerant cycle, wherein both a cooling mode operation for variably controlling the displacement of the variable displacement compressor, thereby controlling car interior cooling temperature to a predetermined level, and a heating mode operation for variably controlling the displacement of the variable displacement compressor, thereby controlling car interior heating temperature to a predetermined level, can be implemented.

Nowadays many cars have come to be equipped with air conditioners which comprise a variable displacement compressor provided with a control valve having a valve body, a pressure sensitive mechanism for sensing the lower pressure side pressure of a refrigerating cycle acting to force the valve body, and a solenoid for forcing the valve body based on an input electric current, wherein position of the control valve is controlled to vary the internal pressure of a control chamber, thereby variably controlling the displacement. In the air conditioner, the lower pressure side pressure of the refrigerant cycle is detected by the pressure sensitive mechanism of the variable displacement compressor, and the displacement of the variable displacement compressor is controlled to self-control the lower pressure side pressure of the refrigerant cycle to a predetermined level, thereby controlling the temperature of a car interior to a predetermined cooling level. Heating mode operation of a car air conditioner provided with a variable displacement compressor is possible by using the high pressure hot gas of the refrigerant cycle. However, a variable displacement compressor provided on a traditional car air conditioner is structured to variably control the displacement thereof to self-control the lower pressure side pressure of the refrigerant cycle to a predetermined level. Therefore, the traditional air conditioner cannot carry out heating mode operation in which the displacement of the variable displacement compressor is variably controlled to self-control the higher pressure side pressure of the refrigerant cycle to a predetermined level, thereby controlling a car interior temperature to a predetermined heating level.

An object of the present invention is to provide an air conditioner comprising a variable displacement compressor and a controller, wherein the variable displacement compressor comprises a control valve provided with a valve body, a pressure sensitive mechanism for sensing the lower pressure side pressure of a refrigerating cycle acting to force the valve body, and a solenoid for forcing the valve body based on an input electric current, position of the control valve is controlled to vary the internal pressure of a control chamber, thereby variably controlling displacement of the variable displacement compressor, and the controller controls the input electric current to the solenoid to control the position of the control valve, and wherein the operation mode of the air conditioner is switchable between cooling mode and heating mode using high pressure hot gas in the refrigerant cycle, and wherein the air conditioner can carry out a cooling mode operation for variably controlling the displacement of the variable displacement compressor to control a car interior temperature to a predetermined cooling level and a heating mode operation for variably controlling the displacement of the variable displacement compressor to control the car interior temperature to a predetermined heating level.

Means for Solving the Problem

In accordance with the present invention, there is provided an air conditioner comprising a variable displacement compressor and a controller, wherein the variable displacement compressor comprises a control valve provided with a valve body, a pressure sensitive mechanism for sensing the lower pressure side pressure of a refrigerating cycle acting to force the valve body and a solenoid for forcing the valve body based on an input electric current, position of the control valve is controlled to vary internal pressure of a control chamber, thereby variably controlling the displacement of the variable displacement compressor, and the controller controls the input electric current to the solenoid to control the position of the control valve, and wherein operation of the air conditioner is switchable between cooling mode and heating mode using highly pressurized hot gas in the refrigerant cycle, and wherein during the cooling mode operation the controller controls the input electric current to the solenoid to operate the control valve based on the lower pressure side pressure of the refrigerant cycle acting on the pressure sensitive mechanism and the quantity of the input electric current to the solenoid, and during the heating mode operation it controls the input electric current to the solenoid to operate the control valve based not on the lower pressure side pressure of the refrigerant cycle acting on the pressure sensitive mechanism but only on the quantity of the input electric current to the solenoid.

When the control valve is operated during a cooling operation based on the lower pressure side pressure of the refrigerant cycle sensed by the pressure sensitive mechanism and the quantity of the input electric current to the solenoid to variably control the displacement of the variable displacement compressor, the lower pressure side pressure of the refrigerant cycle can be controlled to a predetermined level and the cooling temperature can be controlled to a predetermined level. On the other hand, when the control valve is operated during a heating operation not based on the lower pressure side pressure of the refrigerant cycle sensed by the pressure sensitive mechanism but only on the quantity of the input electric current to the solenoid, the higher pressure side pressure of the refrigerant cycle can be controlled to a predetermined level and heating temperature can be controlled to a predetermined level.

In accordance with a preferred embodiment of the present invention, the air conditioner further comprises a diode connected to the solenoid in parallel to form a flywheel circuit. The controller drives a switching element on and off at a predetermined cycle to control the ratio of ON/OFF, i.e., the duty ratio thereof, thereby controlling the quantity of the input electric current to the solenoid, drives the switching element during the cooling mode operation at a first cycle to obtain a smoothing effect of the electric current by the flywheel circuit, and drives the switching element during the heating mode operation at a second cycle lower than the first cycle so as not to obtain the smoothing effect of the electric current by the flywheel circuit.

When the switching element is driven during the cooling mode operation at a first cycle to obtain a smoothing effect of the electric current by the flywheel circuit and the duty ratio of the switching element is controlled, the input electric current to the solenoid can be controlled to control position of the control valve, the lower pressure side pressure of the refrigerant cycle can be self-controlled to a predetermined level, and cooling temperature can be controlled to a predetermined level. On the other hand, when the switching element is driven during the heating mode operation at a second cycle lower than the first cycle so as no to obtain the smoothing effect of the electric current by the flywheel circuit and the duty ratio of the switching element is controlled, the input electric current to the solenoid can be controlled to variably control the ratio of fully opened period and entirely closed period of the control valve, the higher pressure side pressure of the refrigerant cycle can be self-controlled to a predetermined level, and heating temperature can be controlled to a predetermined level.

In accordance with a preferred embodiment of the present invention, the controller comprises a sensor for detecting the higher pressure side refrigerant pressure of the refrigerant cycle or the higher pressure side refrigerant temperature of the refrigerant cycle, and the controller drives the switching element at the second cycle and varies the duty ratio to keep the detected pressure or the detected temperature in a predetermined range during the heating mode operation.

When the higher pressure side refrigerant pressure of the refrigerant cycle or the higher pressure side refrigerant temperature of the refrigerant cycle is controlled to a predetermined range during the heating mode operation, comfortable heating is achieved.

In accordance with a preferred embodiment of the present invention, the controller controls the duty ratio of the switching element to minimize the displacement of the compressor or stops the compressor when the detected pressure or the detected temperature rises to the upper limit beyond the predetermined range during the heating mode operation.

When the duty ratio of the switching element is controlled to minimize the displacement of the compressor or the compressor is stopped in a case where the higher pressure side pressure or the higher pressure side temperature of the refrigerant cycle rises to the upper limit beyond the predetermined range during the heating mode operation, the safety of the air conditioner is maintained.

In accordance with a preferred embodiment of the present invention, the controller decreases the duty ratio to a level lower than a predetermined level when the duty ratio is continuously kept higher than or equal to the predetermined level for a predetermined time during the heating mode operation.

In accordance with a preferred embodiment of the present invention, the controller controls the duty ratio to minimize the displacement of the compressor or stops the compressor when the duty ratio is continuously kept higher than or equal to a predetermined level for a predetermined time during the heating mode operation.

When the duty ratio is decreased to a level lower than a predetermined level or the displacement of the compressor is minimized or the compressor is stopped in a case where the duty ratio is continuously kept higher than or equal to the predetermined level for a predetermined time, temperature rise of the solenoid can be controlled within an appropriate range.

In accordance with a preferred embodiment of the present invention, the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

In accordance with the aforementioned structure, the sensor for detecting the higher pressure side refrigerant pressure of the refrigerant cycle or the higher pressure side refrigerant temperature of the refrigerant cycle can be used not only in the cooling mode operation but also in the heating mode operation. Thus, the structure of the air conditioner is simplified.

In accordance with a preferred embodiment of the present invention, the air conditioner further comprises a check valve disposed in a discharge passage of the variable displacement compressor. The sensor for detecting the higher pressure side refrigerant pressure detects the pressure of the refrigerant upstream of the check valve.

The check valve disposed in a discharge passage of the variable displacement compressor prevents the higher pressure side refrigerant from backflowing into the idling variable displacement compressor during the stop period of the air conditioner and accumulating there as liquid. The sensor for detecting the higher pressure side refrigerant pressure detects the refrigerant pressure upstream of the check valve. Thus, abnormally high pressure in the discharge passage upstream of the check valve is promptly detected when the check valve fails and the safety of the air conditioner is maintained.

Effect of the Invention

In accordance with the air conditioner of the present invention, during the cooling mode operation, the control valve is operated based on the lower pressure side pressure of the refrigerant cycle detected by the pressure sensitive mechanism and the quantity of the input electric current to the solenoid to variably control the displacement of the variable displacement compressor, thereby controlling the lower pressure side pressure of the refrigerant cycle to a predetermined level and controlling the cooling temperature to a predetermined level. On the other hand, during the heating mode operation, the control valve is operated not based on the lower pressure side pressure of the refrigerant cycle detected by the pressure sensitive mechanism but only on the quantity of the input electric current to the solenoid to control the higher pressure side pressure of the refrigerant cycle to a predetermined level and control the heating temperature to a predetermined level.

BEST MODE FOR CARRYING OUT THE INVENTION

Preferred embodiments of the present invention will be described.

First Embodiment

As shown in FIG. 1, a car air conditioner 1 comprises a first refrigerant circuit 10 (hereinafter called refrigerant circuit), a second refrigerant circuit 11 (hereinafter called hot gas bypass circuit), a first electromagnetic valve 12 and a second electromagnetic valve 13 for switching the refrigerant circuit between the refrigerant circuit 10 and the hot gas bypass circuit 11. In the refrigerant circuit 10, highly pressurized hot gas refrigerant discharged from a variable displacement compressor 100 passes through the first electromagnetic valve 12, a condenser 14, a receiver 15, a check valve 16, an expansion valve 17, an evaporator 18 and an accumulator 19 serially in said order, and returns to the variable displacement compressor 100. In the hot gas bypass circuit 11, highly pressurized hot gas refrigerant discharged from the variable displacement compressor 100 passes through the second electromagnetic valve 13, a fixed aperture 20, the evaporator 18 and the accumulator 19 serially in said order, and returns to the variable displacement compressor 100.

When the first electromagnetic valve 12 opens and the second electromagnetic valve 13 closes, the refrigerant circulates in the refrigerant circuit 10. When the first electromagnetic valve 12 closes and the second electromagnetic valve 13 opens, the refrigerant circulates in the hot gas bypass circuit 11.

When the refrigerant circulates in the refrigerant circuit 10, the evaporator 18 operates as a heat exchanger for cooling, wherein cool gas-liquid two phase refrigerant entering through the expansion valve 17 evaporates to cool down the air passing through the evaporator 18. When the refrigerant circulates in the hot gas bypass circuit 11, the evaporator 18 operates as a heat exchanger for heating, i.e., an auxiliary heating apparatus, wherein hot refrigerant gas entering through the fixed aperture 20 heats up the air passing through the evaporator 18.

As shown in FIG. 2, the variable displacement compressor 100 comprises a cylinder block 101 provided with a plurality of cylinder bores 101*a*, a front housing 102 opposing one end of the cylinder block 101, and a rear housing 104 opposing the other end of the cylinder block 101 with a valve plate 103 clamped between them.

The cylinder block 101 cooperates with the front housing 102 to define a crank chamber 105. A driving shaft 106 extends across the crank chamber 105. The driving shaft 106 passes through a swash plate 107. The swash plate 107 is connected to a rotor 108 fixed to the driving shaft 106 through a link 109. The driving shaft 106 supports the swash plate 107 variably at an inclination. A coil spring 110 is disposed between the rotor 108 and the swash plate 107 to force the swash plate 107 in a direction for decreasing the inclination. A coil spring 111 is also provided. The coil spring 111 and the coil spring 110 are disposed to face opposite surfaces of the swash plate 107. The coil spring 111 forces the swash plate 107 in minimum inclination condition in the direction for increasing the inclination.

The driving shaft 106 extends out of the housing at one end through a boss 102*a* of the front housing 102 to be connected to a car engine not through an electromagnetic clutch but directly through a transmission. The car engine and the transmission are not shown in FIG. 2. A shaft seal 112 is disposed between the driving shaft 106 and the boss 102*a*.

The driving shaft 106 is supported radially and longitudinally by bearings 113, 114, 115 and 116.

Pistons 117 are inserted into the cylinder bores 101*a*. Each piston 117 is provided with a concave 117*a* at one end. The concave 117*a* accommodates a pair of shoes 118 for clamping the outer periphery of the swash plate 107 to be slidable relative to the outer periphery of the swash plate 107. Rotation of the driving shaft 106 is converted to reciprocal movement of the piston 117 through the swash plate 107 and the shoes 118.

The rear housing 104 forms a suction chamber 119 and a discharge chamber 120. The suction chamber 119 communicates with the cylinder bores 101*a* through communication holes 103*a* formed in the valve plate 103 and suction valves. The discharge chamber 120 communicates with the cylinder bores 101*a* through discharge valves and communication holes 103*b* formed in the valve plate 103. The suction valves and the discharge valves are not shown in FIG. 2. The suction chamber 119 communicates with the accumulator 19 of the air conditioner 1 through a suction port 104*a* and a pipe.

A muffler 121 is disposed outside the cylinder block 101. The muffler 121 is formed by a cylindrical wall 101*b* formed on the outer surface of the cylinder block 101 and a cover 122 having a cylindrical form closed at one end, independent of the cylinder block 101 and connected to the cylindrical wall 101*b* with a seal member inserted between them. A discharge port 122*a* is formed in the cover 122. The discharge port 122*a* connects to the electromagnetic valves 12 and 13 of the air conditioner 1 through pipes.

A communication passage 123 is formed through the cylinder block 101, the valve plate 103 and the rear housing 104 to communicate the muffler 121 with the discharge chamber 120. The muffler 121 and the communication passage 123 cooperate to form a discharge passage extending between the discharge chamber 120 and the discharge port 122*a*.

A refrigerant pressure sensor 124 for detecting refrigerant pressure in the discharge chamber 120 is fitted to the rear housing 104.

A check valve 200 is disposed in the muffler 121 to open and close the upstream end of the muffler 121 connecting to the communication passage 123. The check valve 200 closes the upstream end of the muffler 121 to shut down the discharge passage extending between the discharge chamber 120 and the discharge port 122*a* when the difference between the pressure acting on the front surface of a valve body and the pressure acting on the rear surface of the valve body is less than a predetermined level, while opening the upstream end of the muffler 121 to open the discharge passage when the difference between the pressure acting on the front surface of the valve body and the pressure acting on the rear surface of the valve body is larger than the predetermined level.

The front housing 102, the cylinder block 101, the valve plate 103 and the rear housing 104 are disposed adjacent to each other with gaskets inserted between them and assembled as a unitary body with a plurality of through bolts.

A displacement control valve 300 is fitted to the rear housing 104. The displacement control valve 300 controls the aperture of a communication passage 125 extending between the discharge chamber 120 and the crank chamber 105 to control the flow rate of the discharging refrigerant gas passing into the crank chamber 105. The refrigerant gas in the crank chamber 105 is passed into the suction chamber 119 through spaces between the bearings 115, 116 and the driving shaft 106, a space 126 formed in the cylinder block 101 and an orifice hole 103*c* formed in the valve plate 103.

The displacement control valve 300 can control the internal pressure of the crank chamber 105 to control the displacement of the variable displacement compressor 100. The displacement control valve 300 controls the supply of electric current to a built-in solenoid based on an external control signal to control the displacement of the variable displacement compressor 100, thereby keeping the internal pressure of the suction chamber 119 at a predetermined level. The displacement control valve 300 stops the supply of electric current to the built-in solenoid to mechanically open the communication passage 125, thereby minimizing the displacement of the variable displacement compressor 100.

As shown in FIG. 3, the displacement control valve 300 comprises a bellows 303 disposed in a pressure sensitive chamber 302 formed in a valve housing 301. The bellows 303 is provided with a vacuum inner space and a spring disposed in the inner space. The bellows 303 operates as a pressure sensitive member for receiving internal pressure of the inlet chamber 119 (hereinafter called inlet pressure) through a communication hole 301*a* and a communication passage 127. The displacement control valve 300 comprises a valve body 304. The valve body 304 is disposed in a valve chamber 312 formed in the valve housing 301 at one end portion to receive internal pressure of the crank chamber 105 (hereinafter called crank chamber pressure) and open and close a valve hole 305*a* disposed on the communication passage 125 between the discharge chamber 120 and the crank chamber 105, slidably supported by a support hole 301*b* formed in the valve housing 301 at the other end portion, and connected to the bellows 303 at the other end. The displacement control valve 300 further comprises a valve seat forming member 305 provided with the valve hole 305*a* and a valve seat 305*b* and press fitted in an accommodation hole 301*c* formed in the valve housing 301, a solenoid rod 304*a* formed integrally with the valve body 304, a movable iron core 306 press fitted on one end of the solenoid rod 304*a*, a fixed iron core 307 fitted on the solenoid rod 304*a* to oppose the movable iron core 306 at a predetermined distance, a spring 308 disposed between the fixed iron core 307 and the movable iron core 306 to force the movable iron core 306 in the opening direction of the valve body 304, a cylindrical member 310 fitting on the fixed iron core 307 and the movable iron core 306 to be fixed to a solenoid case 309, and an electromagnetic coil 311 surrounding the cylindrical member 310 and accommodated in the solenoid case 309.

The pressure sensitive chamber 302 and the bellows 303 form a pressure sensitive mechanism 300A for detecting the inlet pressure acting to force the valve body 304. The solenoid rod 304*a*, the movable iron core 306, the fixed iron core 307, the cylindrical member 310, the electromagnetic coil 311 and the solenoid case 309 form a solenoid 300B for forcing the valve body 304 based on the input electric current. The spring 308 forces the valve body 304 to open the valve hole 305*a* when the solenoid 300B is demagnetized.

A communication hole 301*d* formed in the valve housing 301 at right angles to the valve hole 305*a* crosses the accommodation hole 301*c* and communicates with the discharge chamber 120 through the communication passage 125. Therefore, the valve hole 305*a* communicates with the communication hole 301*d* through the accommodation hole 301*c*. The other end of the valve body 304 connected to the bellows 303 is shut off from the accommodation hole 301*c*. Therefore, the other end of the valve body 304 connected to the bellows 303 is shut off from the discharge chamber 120. The valve chamber 312 communicates with the crank chamber 105 through a communication hole 301*e* and the communication passage 125. The communication hole 301*d*, the accommodation hole 301*c*, the valve hole 305*a*, the valve chamber 312 and the communication hole 301*e* form a part of the communication passage 125 between the discharge chamber 120 and the crank chamber 105.

[Disclosure of the Invention] An air conditioner comprises a variable displacement compressor and a controller 400. The variable displacement compressor comprises a control valve provided with a valve body, a pressure sensitive mechanism 300A for sensing the lower pressure side pressure of a refrigerating cycle acting to force the valve body and a solenoid 300B for forcing the valve body based on an input electric current, position of the control valve is controlled to vary internal pressure of a control chamber, thereby variably controlling the displacement of the variable displacement compressor. The controller 400 controls the input electric current to the solenoid 300B to control the position of the control valve. Operation of the air conditioner is switchable between cooling mode and heating mode using highly pressurized hot gas in the refrigerant cycle. During the cooling mode operation, the controller 400 controls the input electric current to the solenoid 300B to operate the control valve based on the lower pressure side pressure of the refrigerant acting on the pressure sensitive mechanism 300A and the quantity of the input electric current to the solenoid 300B, and during the heating mode operation it controls the input electric current to the solenoid 300B to operate the control valve based not on the lower pressure side pressure of the refrigerant cycle acting on the pressure sensitive mechanism 300A but only on the quantity of the input electric current to the solenoid 300B.

The car air conditioner 1 comprises a controller 400.

As shown in FIG. 4, the controller 400 is connected to an in-vehicle battery 500. The in-vehicle battery 500 supplies the controller 400 with direct current electric power when the ignition switch of a car engine is turned ON.

Various kinds of command signals are sent to the controller 400 from a mode selector switch 401 for selecting an air condition mode between a cooling mode using the refrigerant circuit 10 and an auxiliary heating mode using the hot gas bypass circuit 11, a temperature setting switch 402 for setting interior temperature at a desired level, an air conditioner switch 403 for starting and stopping the variable displacement compressor 100, a flow rate selector switch 404 for selecting flow rate of the fan of the evaporator 18, etc. Various kinds of detection signals are sent to the controller 400 from an interior air temperature sensor 405 for detecting interior air temperature, an outside air temperature sensor 406 for detecting outside air temperature, a solar radiation sensor 407 for detecting interior solar radiation, an evaporator temperature sensor 408 for detecting temperature of the air just after passing through the evaporator 18, an engine cooling water temperature sensor 409 for detecting temperature of engine cooling water flowing into a hot-water heater and the refrigerant pressure sensor 124 for detecting the internal pressure of the discharge chamber 120 (hereinafter called discharge pressure) of the variable displacement compressor 100.

The controller 400 supplies control electric power to an air mix door, a blowout opening selector door, an internal air and external air selector door, a blower motor of the condenser 14, a blower motor of the evaporator 18, the first electromagnetic valve 12, the second electromagnetic valve 13 and the electromagnetic coil 311 of the control valve 300.

The electric power supply line for the electromagnetic coil 311 forms a flywheel circuit 411 with a diode 410 being disposed in parallel to the electromagnetic coil 311. The electric power supply line for the electromagnetic coil 311 is grounded at the trailing end. An electric current sensor 412 is disposed to detect electric current flowing in the flywheel circuit 411. The detection signal of the electric current sensor 412 is sent to the controller 400.

The electric power is supplied to the electromagnetic coil 311 through a switching element not shown in FIG. 4. The quantity of the electric current supplied to the electromagnetic coil 311 is controlled by a pulse width modulation system (PWM control system), wherein the switching element is driven ON/OFF at a predetermined frequency, with the ratio of ON/OFF, i.e., the duty ratio, being varied.

Operation of the car air conditioner 1 will be described.

When the ignition switch of the car engine is switched ON to start the car engine, driving power is transmitted to the variable displacement compressor 100 directly connected to the car engine, and the in-vehicle battery 500 supplies the controller 400 with direct current electric power.

When the mode selector switch 401 selects the cooling mode operation, the controller 400 opens the first electromagnetic valve 12 and closes the second electromagnetic valve 13 to make the refrigerant circuit 10 ready for operation.

When the controller 400 judges based on the command signals from the switches and the detection signals from the sensors that conditions for starting the compressor 100 are fulfilled, the controller 400 drives the switching element ON/OFF at 400 Hz frequency. When the frequency range is 400 Hz or so, the electric current flowing in the electromagnetic coil 311 does not rapidly increase due to inductance of the electromagnetic coil 311 even if the switching element is driven ON and the switching element is driven OFF before the electric current becomes maximum. On the other hand, the electric current returns to the electromagnetic coil 311 due to the diode 410 even if the switching element is driven OFF and the switching element is driven ON before the electric current becomes zero. As a result, smoothed direct electric current circulates in the flywheel circuit 411 as shown in FIG. 5. When the duty ratio is variably controlled, quantity of the smoothed direct electric current circulating in the flywheel circuit 411 and flowing in the electromagnetic coil 311 is variably controlled. Therefore, when the frequency range is 400 Hz or so, the control valve 300 of the variable displacement compressor 100 operates as a closing valve for operating based on the inlet pressure acting on the pressure sensitive mechanism 300A and the electric current flowing in the solenoid 300B. In this situation, the control valve 300 has a control characteristic indicated by formula (1) in FIG. 6. Therefore, it is possible to vary the input electric current, thereby variably controlling the displacement and the inlet pressure as shown in FIG. 7. The control valve 300 has an inlet pressure control characteristic substantially not based on the discharge pressure Pd because Sv is only a little larger than Sr in the formula (1).

The controller 400 determines a target air temperature so as to control the temperature of the air at the exit of the evaporator 18 at a predetermined level based on the command signals from the switches and the detection signals from the sensors. The controller 400 compares the air temperature detected by the evaporator temperature sensor 408 with the target temperature to determine a target control electric current based on the difference between them. The controller 400 compares the detection signal from the electric current sensor 412 with the target control electric current to adjust the duty ratio of the switching element based on the difference between them, thereby adjusting the electric current flowing in the electromagnetic coil 311. The controller 400 feedback controls the displacement of the variable displacement compressor 100 so as to make the electric current flowing in the electromagnetic coil 311 equal to the target control electric current, or make the inlet pressure equal to a target inlet pressure, or finally make the air temperature detected by the evaporator temperature sensor 408 equal to the target air temperature.

When the mode selector switch 401 selects the auxiliary heating mode operation, the controller 400 closes the first electromagnetic valve 12 and opens the second electromagnetic valve 13 to make the hot gas bypass circuit 11 ready for operation.

When the controller 400 judges based on the command signals from the switches and the detection signals from the sensors that conditions for starting the compressor 100 are fulfilled, the controller 400 drives the switching element ON/OFF at 10 Hz frequency. When the frequency range is 10 Hz or so, the electric current increases to the maximum current decided by the voltage of the in-vehicle battery 500 and the resistance of the electromagnetic coil 311 after the switching element is driven ON. As a result, the electromagnetic force of the solenoid 300B becomes maximum and the valve body 304 of the control valve 300 moves in the closing direction regardless of the level of the inlet pressure acting on the bellows 303. Thereafter, when the switching element is driven OFF, the electric current decreases to zero. As a result, the solenoid 300B is demagnetized and the valve body 304 is forced by the spring 308 to move in the opening direction regardless of the level of the inlet pressure acting on the bellows 303. Thus, when the frequency range is 10 Hz or so, the control valve 300 operates as a two position ON/OFF valve and a duty controlled ON/OFF valve.

When the control valve 300 operates as a duty controlled ON/OFF valve, the ratio of open period to closed period varies depending on the duty ratio. When the duty ratio is 0%, the control valve 300 is always fully open to make the displacement of the variable displacement compressor 100 minimum. When the duty ratio is 100%, the control valve 300 is always fully closed to make the displacement of the variable displacement compressor 100 maximum. Therefore, the displacement of the variable displacement compressor 100 can be variably controlled between the minimum level and the maximum level by variably controlling the duty ratio between 0% and 100%.

The controller 400 determines a target discharge pressure so as to control the discharge pressure of the variable displacement compressor 100 at a predetermined level based on the command signals from the switches and the detection signals from the sensors. The controller 400 compares the pressure detected by the pressure sensor 124 with the target discharge pressure to adjust the duty ratio of the switching element based on the difference between them, thereby adjusting the ratio between the fully open period of the control valve 300 and the fully closed period of the control valve 300. The controller 400 feedback controls the displacement of the variable displacement compressor 100 so as to make the pressure detected by the pressure sensor 124 equal to the target discharge pressure. As a result, the discharge pressure of the variable displacement compressor 100 is controlled to a predetermined level to control the temperature of the air at the exit of the evaporator 18 to a predetermined level.

Control flow of the air conditioner 1 during the auxiliary heating mode operation will be described with reference to FIG. 8. The control valve 300 is driven under a condition of solenoid driving frequency=10 Hz and initial duty ratio=DT0. When the discharge pressure Pd detected by the pressure sensor 124 is $Pd1<Pd<Pd2$, the current duty ratio is kept to keep the current displacement. When the Pd is $Pd1>Pd$, the control valve 300 is driven at a duty ratio increased by a predetermined quantity $\Delta Pd$ to increase the displacement, thereby increasing the discharge pressure.

When the Pd is Pd>Pd2, the control valve 300 is driven at a duty ratio decreased by a predetermined quantity ΔPd to decrease the displacement, thereby decreasing the discharge pressure. As a result, the discharge pressure Pd is kept in the range Pd1<Pd<Pd2, the temperature of the air at the exit of the evaporator 18 is kept in a predetermined range, and comfortable interior heating of the car is maintained.

The pressure sensor 124 can be used both in the cooling mode operation and in the heating mode operation because it is located upstream of the first electromagnetic valve 12 and the second electromagnetic valve 13. As a result, the structure of the air conditioner 1 is simplified.

The pressure sensor 124 can promptly detect abnormally high pressure in the discharge passage upstream of the check valve 200 when the check valve 200 does not open due to failure because the pressure sensor 124 is located upstream of the check valve 200. Thus, the safety of the air conditioner is maintained.

Second Embodiment

A protector may be provided to reduce the duty ratio to 0%, thereby demagnetizing the solenoid 300B to minimize the displacement of the variable displacement compressor 100 when Pd rises to Pd3(Pd3>>Pd2) beyond the range Pd1<Pd<Pd2. This maintains the safety of the air conditioner 1.

The resistance of the electromagnetic coil 311 is set at 10Ω or less at room temperature so as to widen the controllable range of the inlet pressure. In the auxiliary heating mode operation, the electric current is liable to be continuously applied to the electromagnetic coil 311 for a long time. Therefore, the temperature of the solenoid 300B is liable to rise, thereby causing rapid deterioration of the solenoid 300B. When a predetermined duty ratio is kept for a predetermined time in the heating mode operation, the duty ratio can be decreased to a level lower than the predetermined level prior to a control for achieving higher pressure, or the duty ratio can be decreased to 0% to minimize the displacement of the variable displacement compressor 100, thereby preventing the deterioration of the solenoid 300B.

The variable displacement compressor 100 can be connected to the car engine through an electromagnetic clutch. In this case, the electromagnetic clutch can be cut OFF to stop the variable displacement compressor 100, thereby maintaining the safety of the air conditioner 1 when Pd rises to Pd3 (Pd3>>Pd2) beyond the range Pd1<Pd<Pd2 in the auxiliary heating mode operation, or the electromagnetic clutch can be cut OFF to stop the variable displacement compressor 100, thereby preventing the deterioration of the solenoid 300B when a predetermined duty ratio is kept for a predetermined time in the auxiliary heating mode operation.

A temperature sensor for detecting temperature of the refrigerant in the discharge chamber 120 can be disposed instead of the pressure sensor 124 to duty control the control valve 300, thereby keeping the temperature Td of the discharging refrigerant in a range Td1<Td<Td2 in the auxiliary heating mode operation. In this case, a protector may be provided to reduce the duty ratio to 0%, thereby demagnetizing the solenoid 300B to minimize the displacement of the variable displacement compressor 100 when Td rises to Td3 (Td3>>Td2) beyond the range Td1<Td<Td2. This maintains the safety of the air conditioner 1. In a case where the variable displacement compressor 100 is connected to the car engine through an electromagnetic clutch, the electromagnetic clutch can be cut OFF to stop the variable displacement compressor 100 when Td rises to Td3(Td3>>Td2) beyond the range Td1<Td<Td2 in the auxiliary heating mode operation. This maintains the safety of the air conditioner 1.

INDUSTRIAL APPLICABILITY

The present invention can be used for the following air conditioners.

1. An air conditioner comprising a variable displacement compressor provided with a control valve having a pressure sensitive mechanism operating based on the pressure difference between the pressure at a point located lower pressure side and the pressure at a point located higher pressure side.
2. An air conditioner comprising a variable displacement compressor driven by a motor.
3. An air conditioner comprising a variable displacement compressor of scroll type, vane type or wobble plate type.
4. An air conditioner using CO2 or R152a instead of R134a as refrigerant.
5. An air conditioner having a heat pump type heating mode operation.
6. An air conditioner other than a car air conditioner.
7. An air conditioner comprising not the pressure sensor 124 but instead a temperature sensor for detecting the higher pressure side refrigerant temperature or surface temperature of the evaporator 18.

BRIEF DESCRIPTION OF THE DRAWINGS

FIG. 6 is a view showing a control characteristic formula of the displacement control valve of FIG. 3.

BRIEF DESCRIPTION OF THE REFERENCE NUMERALS

Figure 1:
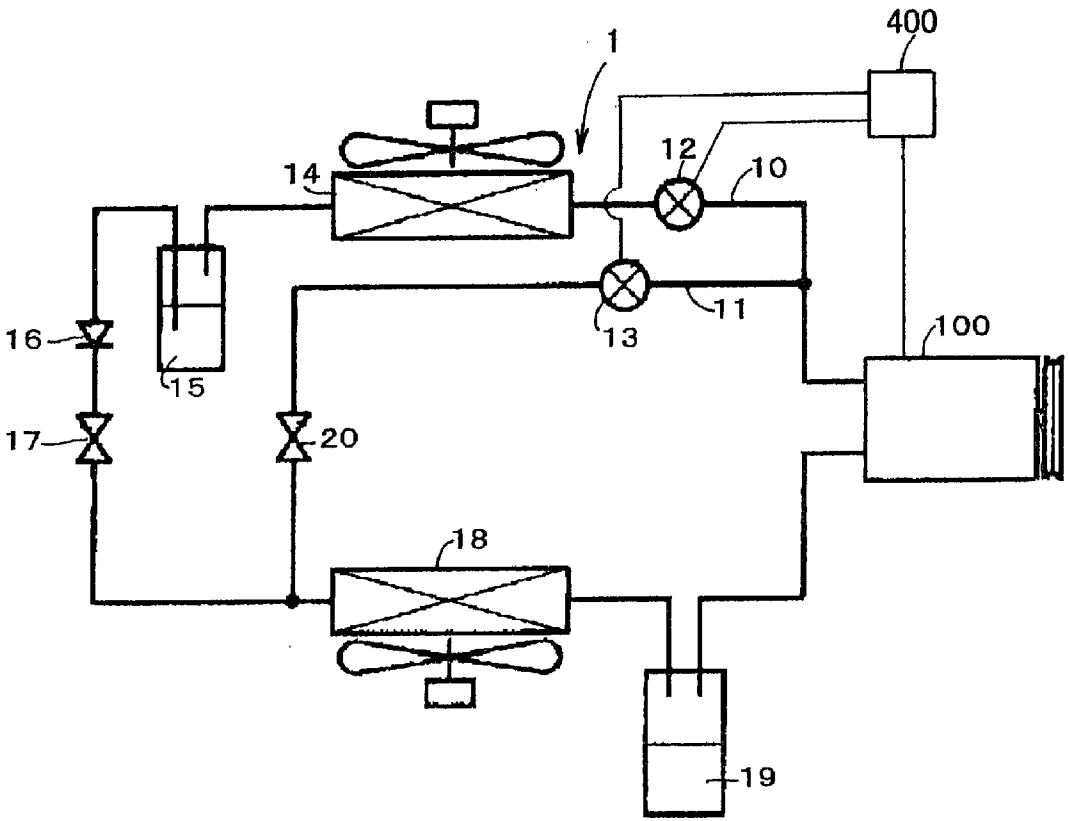
FIG. 1 is a block diagram of an air conditioner in accordance with a preferred embodiment of the present invention.
Figure 2:
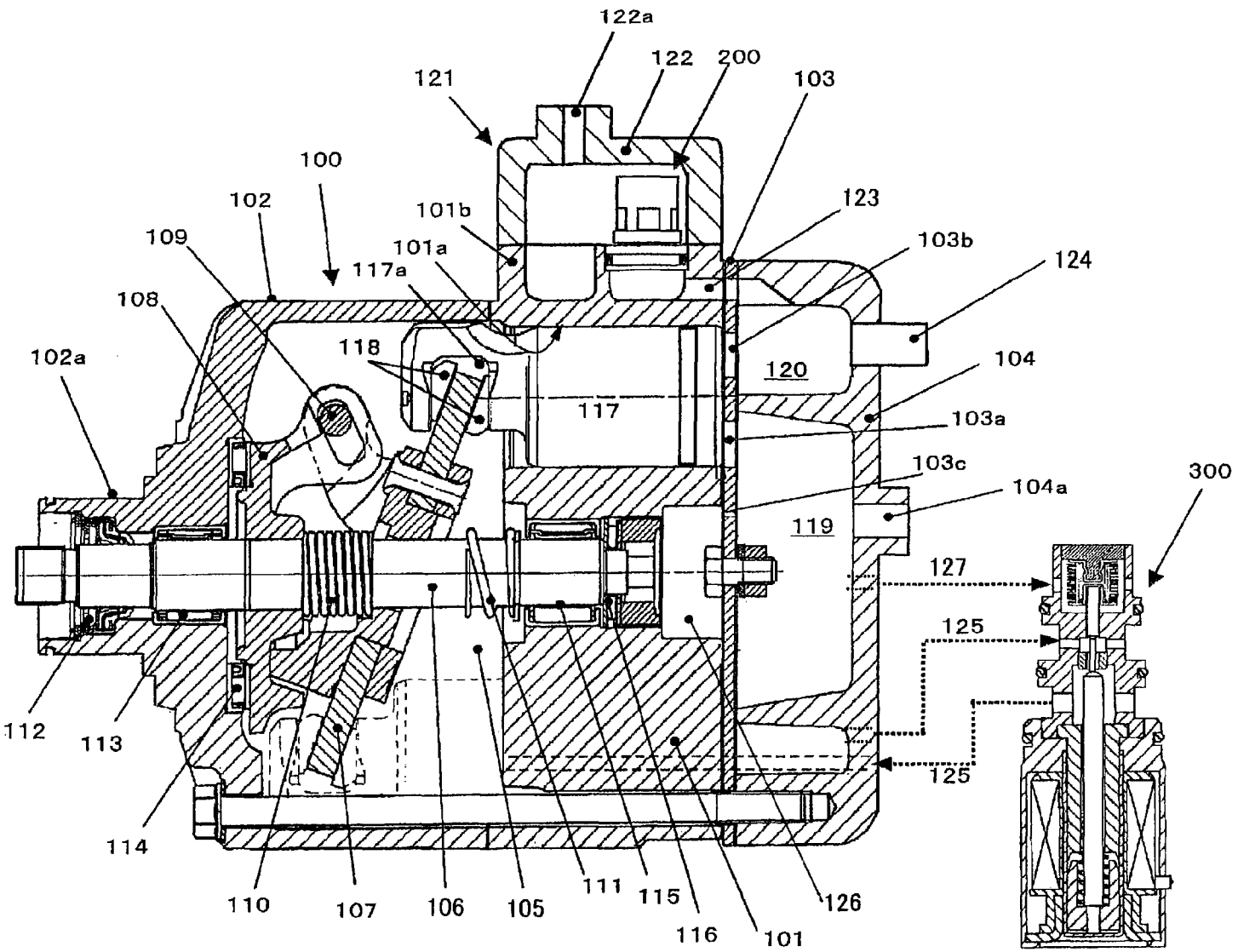
FIG. 2 is a sectional view of a variable displacement compressor provided on the air conditioner in accordance with a preferred embodiment of the present invention.
Figure 3:
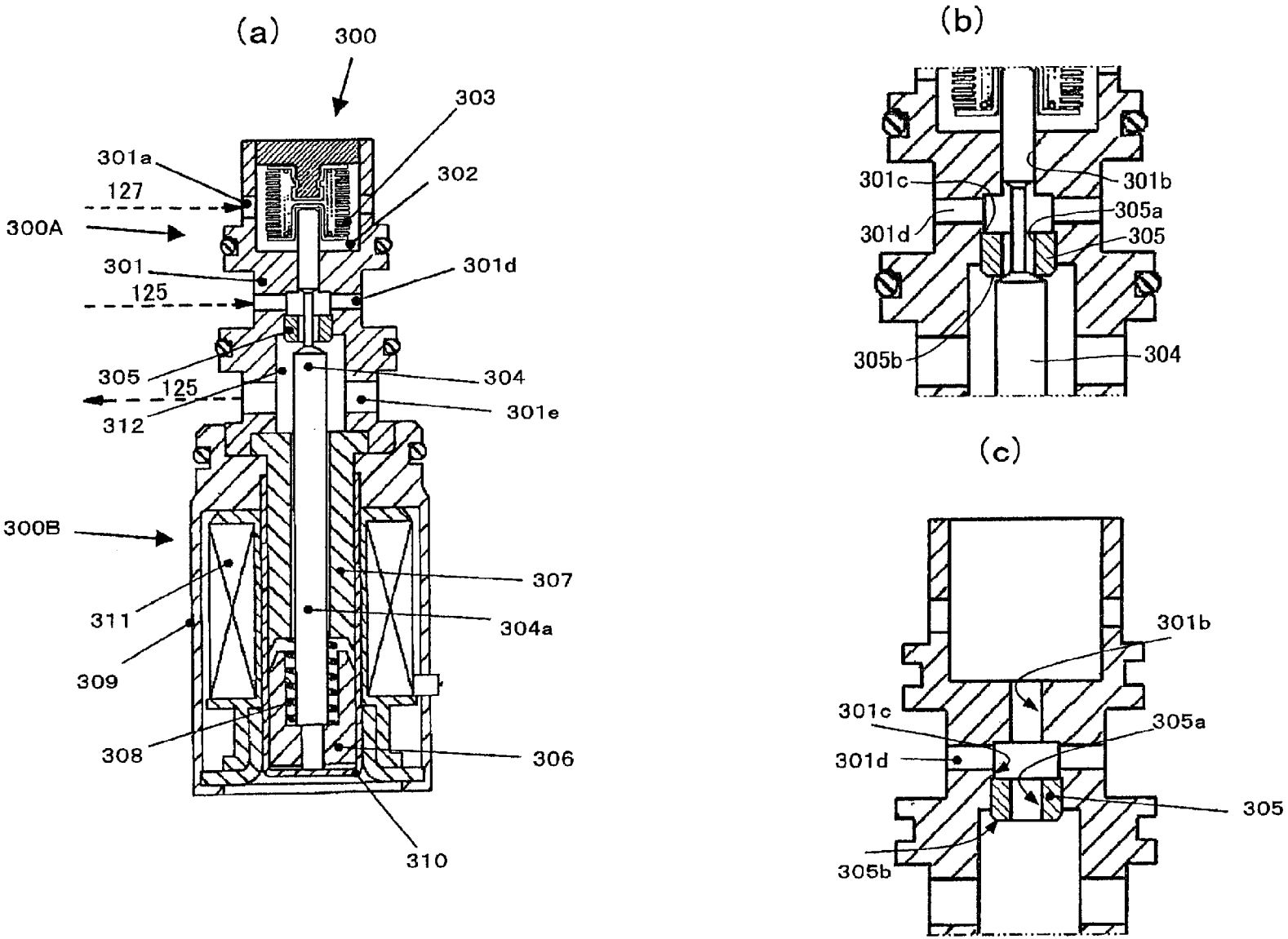
FIG. 3 is a structural view of a displacement control valve of a variable displacement compressor provided on the air conditioner in accordance with a preferred embodiment of the present invention. (a) is a general sectional view, (b) is a fragmentary enlarged sectional view at the closed condition at and (c) is a fragmentary enlarged sectional view without a valve body.
Figure 4:
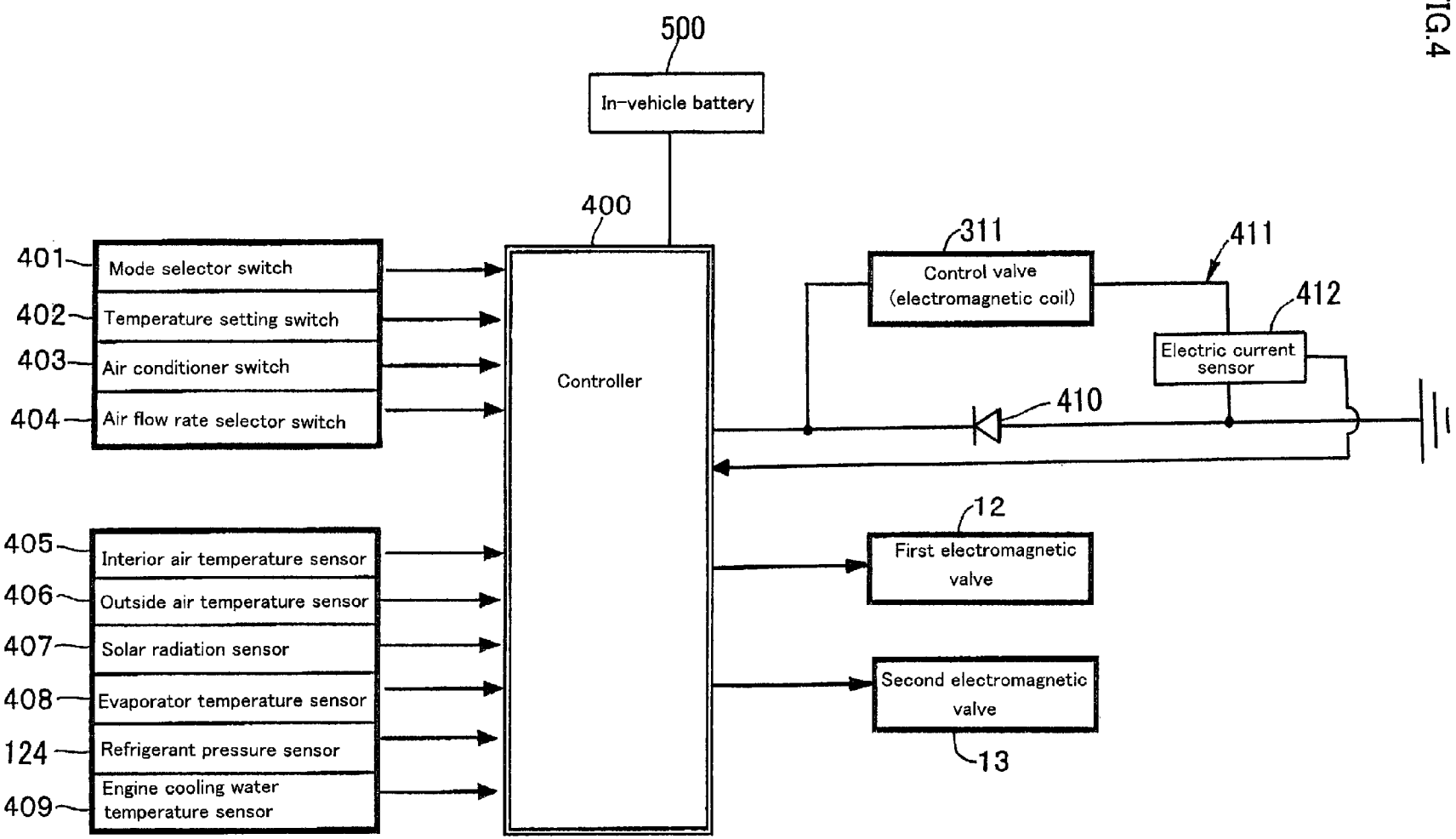
FIG. 4 is a block diagram of a controller provided on the air conditioner in accordance with a preferred embodiment of the present invention.
Figure 5:
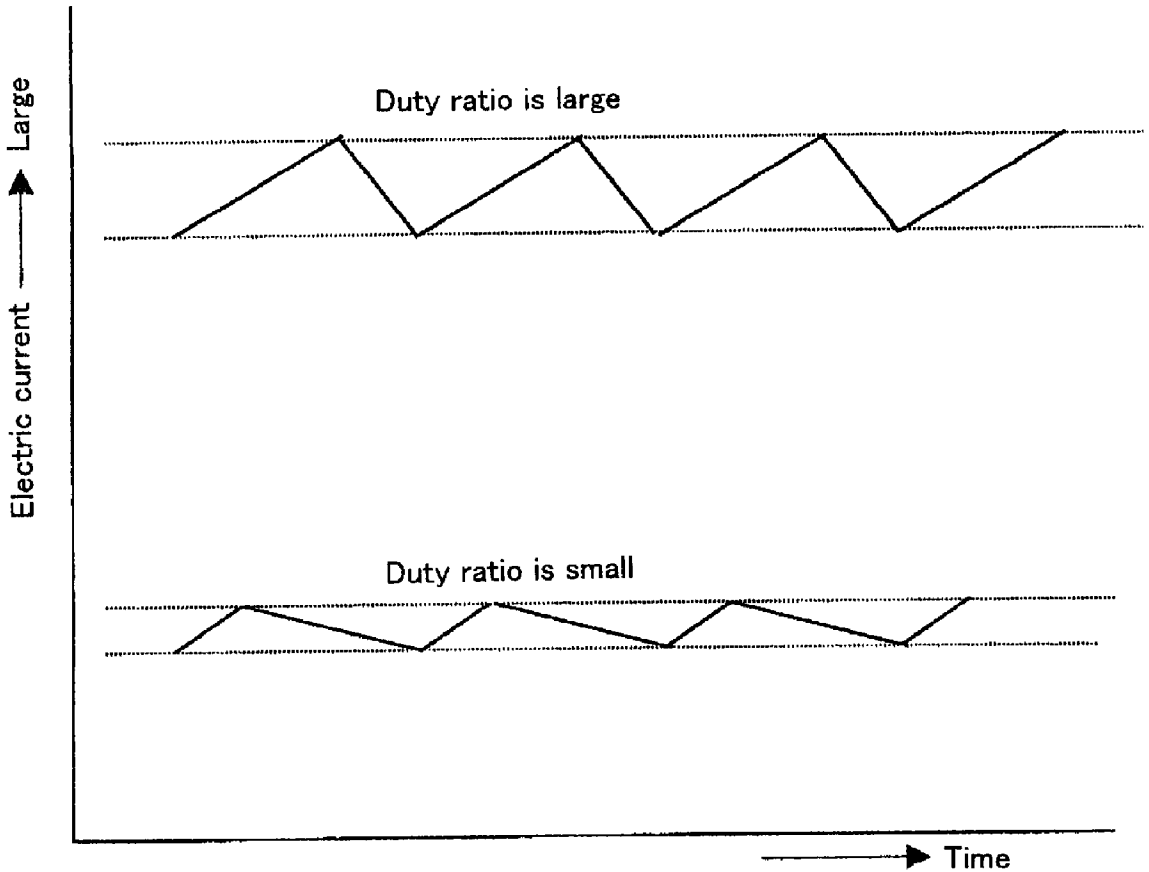
FIG. 5 is a graph showing the electric current controlled by pulse-width modulation system and flowing in the electromagnetic coil of the control valve of FIG. 3.
Figure 7:
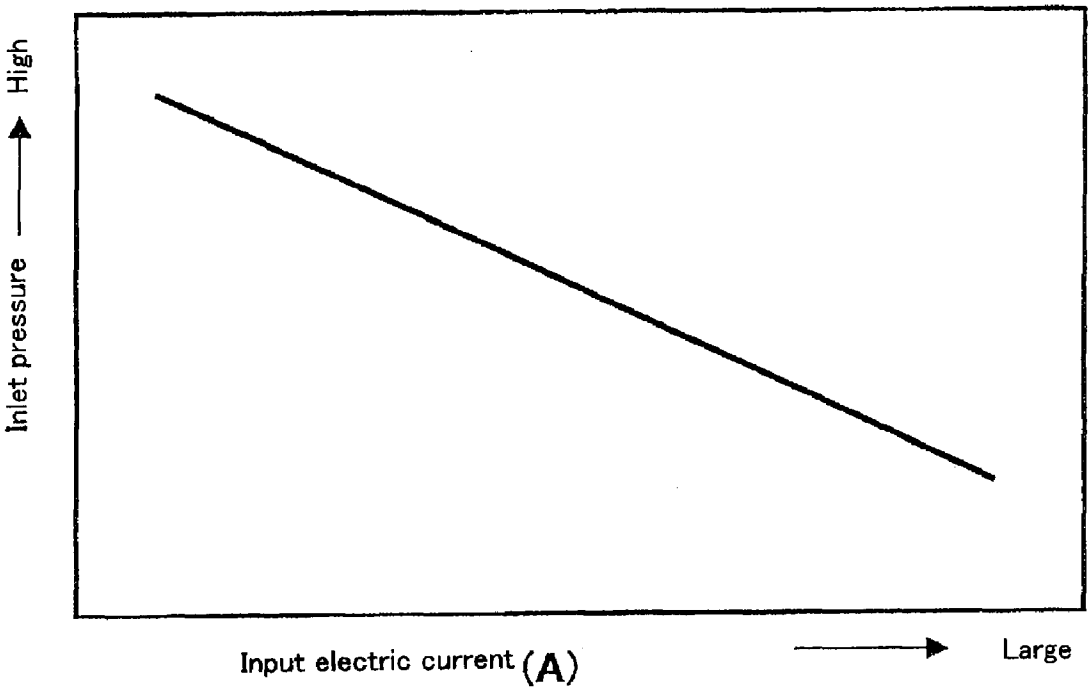
FIG. 7 is a diagram showing a control characteristic of the displacement control valve of FIG. 3.
Figure 8:
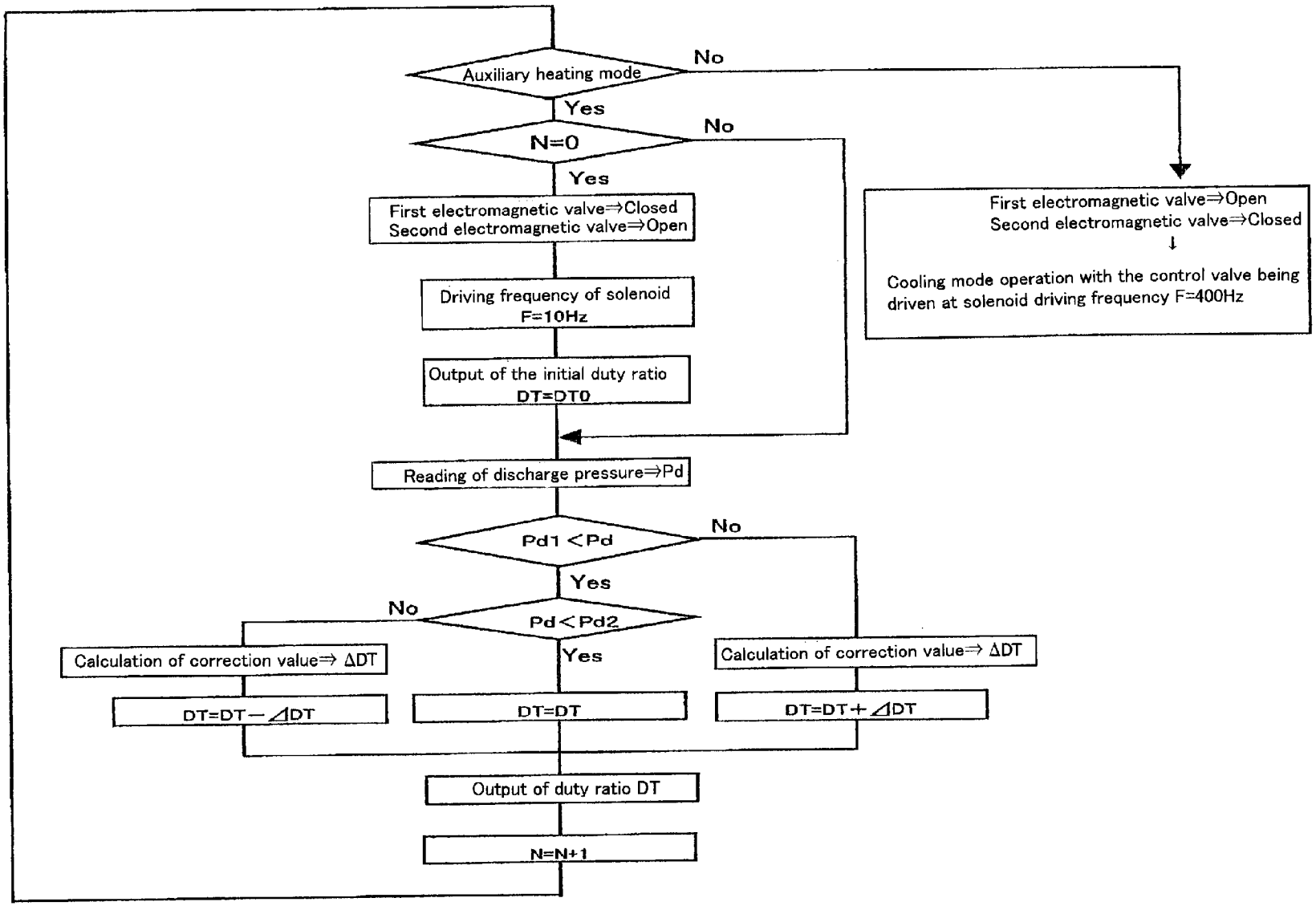
FIG. 8 is a view showing a control flow of the air conditioner in accordance with a preferred embodiment of the present invention.

1 Air conditioner
12 First electromagnetic valve
13 Second electromagnetic valve
14 Condenser
18 Evaporator
100 Variable displacement compressor
124 Pressure sensor
200 Check valve
300 Displacement control valve
311 Electromagnetic coil

400 Controller
411 Flywheel circuit
500 In-vehicle battery

The invention claimed is:

1. An air conditioner comprising a variable displacement compressor and a controller, wherein the variable displacement compressor comprises a control valve provided with a valve body, a pressure sensitive mechanism for sensing the lower pressure side pressure of a refrigerating cycle acting to force the valve body and a solenoid for forcing the valve body based on an input electric current, position of the control valve is controlled to vary internal pressure of a control chamber, thereby variably controlling the displacement of the variable displacement compressor, and the controller controls the input electric current to the solenoid to control the position of the control valve, and wherein operation of the air conditioner is switchable between cooling mode and heating mode using highly pressurized hot gas in the refrigerant cycle, and wherein during the cooling mode operation the controller controls the input electric current to the solenoid to operate the control valve based on the lower pressure side pressure of the refrigerant cycle acting on the pressure sensitive mechanism and the quantity of the input electric current to the solenoid, and during the heating mode operation controls the input electric current to the solenoid to operate the control valve based not on the lower pressure side pressure of the refrigerant cycle acting on the pressure sensitive mechanism but only on the quantity of the input electric current to the solenoid.

2. An air conditioner of claim 1, further comprising a diode connected to the solenoid in parallel to form a flywheel circuit, and wherein the controller drives a switching element on and off at a predetermined cycle to control a duty ratio of ON/OFF, thereby controlling the quantity of the input electric current to the solenoid, drives the switching element during the cooling mode operation at a first cycle to obtain a smoothing effect of the electric current by the flywheel circuit, and drives the switching element during the heating mode operation at a second cycle lower than the first cycle so as not to obtain the smoothing effect of the electric current by the flywheel circuit.

3. An air conditioner of claim 2, wherein the controller comprises a sensor for detecting the higher pressure side refrigerant pressure of the refrigerant cycle or the higher pressure side refrigerant temperature of the refrigerant cycle, and wherein the controller drives the switching element at the second cycle and varies the duty ratio to keep the detected pressure or the detected temperature in a predetermined range during the heating mode operation.

4. An air conditioner of claim 3, wherein during the heating mode operation the controller controls the duty ratio of the switching element to minimize the displacement of the compressor or stops the compressor when the detected pressure or the detected temperature vises to the upper limit beyond the predetermined range.

5. An air conditioner of claim 4, wherein during the heating mode operation the controller decreases the duty ratio to a level lower than a predetermined level when the duty ratio is continuously kept higher than or equal to the predetermined level for a predetermined time.

6. An air conditioner of claim 5, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

7. An air conditioner of claim 4, wherein during the heating mode operation the controller controls the duty ratio to minimize the displacement of the compressor or stops the compressor when the duty ratio is continuously kept higher than or equal to a predetermined level for a predetermined time.

8. An air conditioner of claim 7, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

9. An air conditioner of claim 4, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

10. An air conditioner of claim 3, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

11. An air conditioner of claim 10, further comprising a check valve disposed in a discharge passage of the variable displacement compressor, and wherein the sensor for detecting the higher pressure side refrigerant pressure detects the pressure of the refrigerant upstream of the check valve.

12. An air conditioner of claim 3, wherein during the heating mode operation the controller decreases the duty ratio to a level lower than a predetermined level when the duty ratio is continuously kept higher than or equal to the predetermined level for a predetermined time.

13. An air conditioner of claim 12 wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

14. An air conditioner of claim 3, wherein during the heating mode operation the controller controls the duty ratio to minimize the displacement of the compressor or stops the compressor when the duty ratio is continuously kept higher than or equal to a predetermined level for a predetermined time.

15. An air conditioner of claim 14, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

16. An air conditioner of claim 2, wherein during the heating mode operation the controller decreases the duty ratio to a level lower than a predetermined level when the duty ratio is continuously kept higher than or equal to the predetermined level for a predetermined time.

17. An air conditioner of claim 16, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

18. An air conditioner of claim 2, wherein during the heating mode operation the controller controls the duty ratio to minimize the displacement of the compressor or stops the compressor when the duty ratio is continuously kept higher than or equal to a predetermined level for a predetermined time.

19. An air conditioner of claim 18, wherein the sensor for detecting the higher pressure side refrigerant pressure of the refrigerant cycle or the higher pressure side refrigerant temperature of the refrigerant cycle is located upstream of a refrigerant circuit switching valve for switching the operation mode between the cooling mode and the heating mode.

* * * * *